US007454941B2

(12) United States Patent
Bergue et al.

(10) Patent No.: US 7,454,941 B2
(45) Date of Patent: Nov. 25, 2008

(54) UPSETTING METHOD FOR WORKING A METAL SLUG, METHOD FOR PREPARING A SLUG FOR A FORGING OPERATION ACCORDING TO THE METHOD AND DEVICE FOR IMPLEMENTING THE METHOD

(75) Inventors: Jean-Pierre Serge Bergue, Soisy sous Montmorency (FR); Michel Breton, Rieux (FR); Philippe Francois Christian Sagot, Bois Colombes (FR); Patrice Rene Sagne, Vineuil St Firmin (FR)

(73) Assignee: SNECMA, Paris (FR)

( * ) Notice: Subject to any disclaimer, the term of this patent is extended or adjusted under 35 U.S.C. 154(b) by 0 days.

(21) Appl. No.: 11/260,143

(22) Filed: Oct. 28, 2005

(65) Prior Publication Data

US 2006/0090535 A1 May 4, 2006

(30) Foreign Application Priority Data

Oct. 29, 2004 (FR) ..... 04 52483

(51) Int. Cl.
*B21D 22/02* (2006.01)

(52) U.S. Cl. ..... 72/359; 72/352; 72/342.8

(58) Field of Classification Search ..... 72/359, 72/358, 377, 356, 352, 478, 339, 342.8, 342.7
See application file for complete search history.

(56) References Cited

U.S. PATENT DOCUMENTS 1,345,045 A * 6/1920 Waters ..... 72/339
2,369,299 A * 2/1945 Kafowi ..... 72/343
3,844,155 A * 10/1974 Bew et al. ..... 72/356
4,312,210 A * 1/1982 Nishizawa et al. ..... 72/267
4,607,515 A * 8/1986 Goodfellow ..... 72/358
4,918,969 A * 4/1990 Takeuchi et al. ..... 72/334
2006/0185415 A1 * 8/2006 Bergue et al. ..... 72/347

FOREIGN PATENT DOCUMENTS

DE 21 61 543 A1 7/1972
DE 199 11 118 A1 9/1999
JP 05115939 A * 5/1993

OTHER PUBLICATIONS

U.S. Appl. No. 11/260,143, filed Oct. 28, 2005, Bergue et al.
U.S. Appl. No. 11/357,033, filed Feb. 21, 2006, Bergue et al.

* cited by examiner

*Primary Examiner*—Derris H. Banks
*Assistant Examiner*—Debra M Wolfe
(74) *Attorney, Agent, or Firm*—Oblon, Spivak, McClelland, Maier & Neustadt, P.C.

(57) ABSTRACT

The invention relates to an upsetting method for working a metal slug having a determined slenderness, characterized by the fact that the slug is at least partly positioned in the direction of its length, in an upsetting pot in a cylindrical housing provided for this purpose, and pressure is exerted on the slug in the direction of its length by means of a punch, until the slug fills the whole section of the housing, so as to reduce its slenderness, and to obtain a cylindrical slug with a section equal to that of the housing, in preparation for a forging operation. By this method, it is possible to upset slugs with large slenderness.

20 Claims, 1 Drawing Sheet

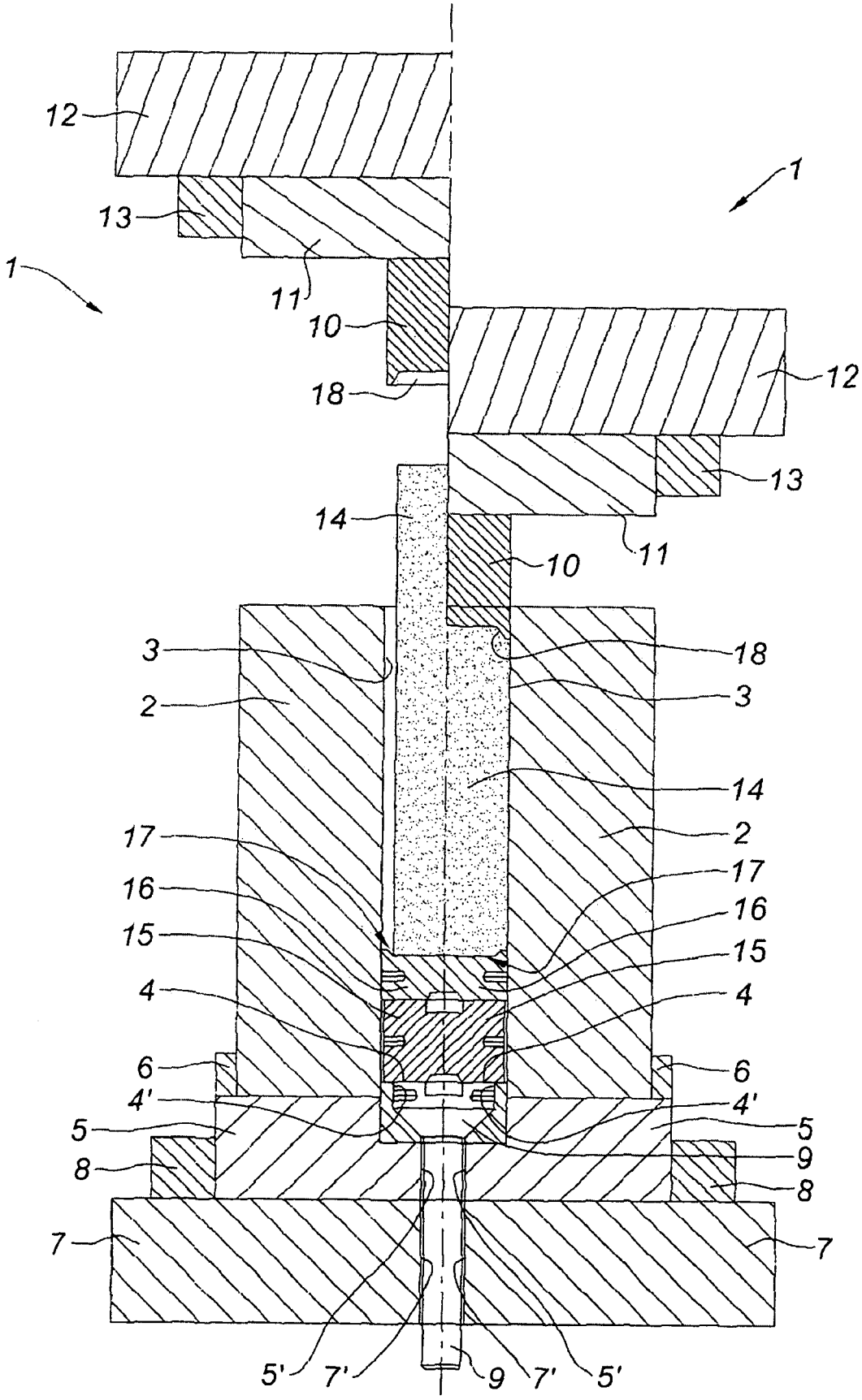
12
13
1
11
10
18
12
1
13
14
11
10
3
18
2
3
14
2
17
17
16
16
15
15
4
4
6
6
4'
4'
5
5
8
9
8
7
7
5'
7'
9
7'
5'

UPSETTING METHOD FOR WORKING A METAL SLUG, METHOD FOR PREPARING A SLUG FOR A FORGING OPERATION ACCORDING TO THE METHOD AND DEVICE FOR IMPLEMENTING THE METHOD

BACKGROUND OF THE INVENTION

1. Field of the Invention

The invention relates to an upsetting method for working a metal slug, a method for preparing a slug for a forging operation according to the method and a device for implementing the method.

2. Discussion of the Background

Forged metal parts are generally obtained by forging of slugs or billets which are raw blanks of semi-finished metal parts globally in the form of bars, used as basic elements for forming the part to be obtained by forging, their volume corresponding to the volume of the latter, increased by the lost volume during the forging. For example, in a turbojet engine, the fan disks or compressor drums are obtained by forging metal slugs.

In the aeronautical field, the safety criteria are restricting and impose checks at all the manufacturing steps. The slugs must notably be checked, for example with ultrasound, in order to detect the presence of inclusions or defects in the metal, which are at the origin of cracks during forging and possibly of failures of the finished part. In order to provide a satisfactory check with ultrasound, recent standards impose a relatively small section for the slugs, in the special case of the aeronautical field, of the order of 150 to 330 mm for nickel- or titanium-based metal slugs. If the finished parts of the turbojet engine are of a large volume, the slugs should therefore be of large slenderness, to compensate their small section.

These slugs, for which the length-over-section-diameter ratio, i.e., the slenderness, may initially be of the order of 12 for 1, should therefore be worked a plurality of times, in order to obtain slugs for which the slenderness in the special case is substantially equal to 3 for 1, a ratio for which it is possible to forge them, without their being contained sideways, without any risks of buckling or creation of defects in the fibers of the metal. The values given here correspond to nickel- or titanium-based metal slugs, with the rheology used for manufacturing parts of a turbojet engine. Working means hot deformation of a metal part in order to obtain an increase in its diameter and a reduction of its length, at an equal volume. Working is here obtained by upsetting, by placing the metal slug under pressure.

The prior art proposes upsetting devices for working metal slugs comprising two half-shells, each including a frustroconical shaped housing. A slug is positioned in the lower half-shell, the two half-shells being pressed against each other by a press, in order to provide upsetting of the slug which therefore assumes the shape, here with a hexagonal longitudinal section, corresponding to the housing between both half-shells. Several upsetting operations are required for obtaining the slug which may be used in the forge.

As the primary slugs, i.e., the slugs as provided before the first upsetting, are of large slenderness, there is a risk of buckling during upsetting. It is therefore necessary to proceed with a large number of upsetting operations, the slenderness being only slightly reduced at each operation, in order to obtain a slug, to reduce the risk of buckling, without however canceling the latter. As the geometry of the shells is fixed, it is necessary to have as many upsetting devices as there are geometries of slugs, both from the point of view of their section and of their length; the number of required devices is therefore very large because of the different geometries and volumes of the parts of a turbojet engine on the one hand, of the necessity of carrying out a large number of upsetting operations on the other hand. Moreover, the dimensions of the devices from the prior art are large, because of the presence of two half-shells. The obtained slugs are already in the form of blanks, since they conform to the shape of both half-shells, which may be a nuisance for their forging; metal flashes formed at the contact between both half-shells should further be suppressed by machining. Finally, the heat losses during the upsetting operation are large, as the slug extends between both half-shells at a distance from one another and therefore is in contact with air.

SUMMARY OF THE INVENTION

The invention aims at overcoming these drawbacks.

For this purpose, the invention relates to an upsetting method for working a metal slug, having a determined slenderness, characterized by the fact that the slug is at least partly positioned in the direction of its length in an upsetting pot, into a cylindrical housing provided for this purpose, and pressure is exerted on the slug in the direction of its length by means of a punch, until the slug fills the whole section of the housing, in order to reduce its slenderness and to obtain a cylindrical slug with a section equal to that of the housing, in preparation for a forging operation.

By means of the invention, the applicant has observed that it was possible to obtain a working rate, i.e., the ratio of the length of the slug before working, over the length of the slug after working, larger than 30%, the worked slug exhibiting neither buckling nor fiber anomalies. It is thereby possible to reduce the number of upsetting operations. Moreover, the obtained slug is of a cylindrical shape, easier to be forged into any shape subsequently. As the punch may be of smaller dimensions than those of a half-shell of the prior art, the bulkiness of the device may be reduced. As the slug at least partially extends into the cylindrical housing, heat losses are reduced and the flashes requiring machining are eliminated, if the slug wholly extends in its housing at the end of upsetting. Further, the method may be arranged so that the upsetting operation is stopped when a certain stress of the punch is attained, which provides better control over the operation as compared with the prior art where the operation was stopped when both half-shells were in contact, independently of the slug which they contained. Moreover, in such an upsetting method, which is performed in a closed volume (i.e., only air but not metal may escape from the enclosure formed by the housing and the punch), at the end of the method a slug with a cylindrical shape is obtained, the fibers of which are all substantially parallel to the axis of the cylinder; this feature is advantageous for aeronautical applications.

Advantageously, the housing has a diameter up to 1.35 times the diameter of the section of the slug.

The invention also relates to a method for preparing a slug, for which the initial slenderness is larger than 12 for 1, for a forging operation, wherein the slug is upset a plurality of times according to the method shown below, until a slenderness substantially equal to 3 for 1 is obtained.

Finally the invention relates to a device for applying the above method, characterized by the fact that it includes an upsetting pot, with a cylindrical housing for receiving the slug, and a punch for putting the slug under pressure.

Advantageously, the punch is driven by a press table.

Preferably, the depth of the housing is adjustable according to the dimensions of the slug.

In this case, it is possible to only use one device for slugs of different slendernesses, which reduces the number of required devices and therefore production costs and bulkiness.

BRIEF DESCRIPTION OF THE DRAWINGS

The invention will be better understood with the help of the following description of the preferred embodiment of the invention, with reference to the single appended FIGURE, which illustrates a schematic sectional profile view of the device of the invention, with the punch in the high position, for the left half of the FIGURE, and the punch in the low position for the right half of the FIGURE.

DESCRIPTION OF THE PREFERRED EMBODIMENTS

The upsetting device 1 includes an upsetting pot 2, in this special case with a cylindrical shape, in steel. The pot 2 includes a housing 3, or sheath 3, with a cylindrical shape, central here relatively to the section of the pot 2, and which includes a bottom 4. The pot 2 is positioned on a supporting table 5, also in steel, which includes a flange 6 for centering the pot 2. The table 5 is supported by a lower press table 7, fixed, in steel, which includes a flange 8 for centering the table 5 supporting the pot 2.

Here, the bottom 4 of the housing 3 is pierced with a bore 4' for letting through a cylinder 9, which also extends through bores 5', 7' provided in the table 5 supporting the pot 2 and the lower press table 7, respectively. During an upsetting operation, the upper surface of the cylinder 9, perfectly fitted into the bore 4' of the bottom 4, may here provide the function of bottom of the housing 3.

The upsetting device 1 includes, above the pot 2, a punch 10, with a cylindrical shape, supported at its upper end by a punch plate 11, itself permanently attached to an upper press table 12, which includes a flange 13 for centering the punch plate 11. These elements are in steel here. The upper press table 12 is mobile translationally and vertically, along the axis of the punch 10. The section of the punch 10 corresponds to the section of the housing 3 of the pot 2.

The housing 3 is arranged in order to receive a metal slug 14. It is arranged in order to be able to also receive, on its bottom 4, in the special case, on the upper surface of the cylinder 9, blocks 15, 16, in steel here. They are two in number in the FIGURE, and positioned over each other. These blocks 15, 16, the section of which corresponds to the section of the housing 3 of the pot 2, allow the depth of the housing 3 to be adjusted according to the length of the slug 14 to be upset. It is therefore the upper surface of the upper block 16 which acts as bottom for the slug 14.

Here, the bottom of the housing 3, whether it is the upper surface of the cylinder 9 or the upper surface of a block 16, includes an impression 17 for centering and pre-forming the slug 14. In this special case, this impression 17 includes a small flange at its circumference, forming a shoulder, the distance of which to the axis of the cylinder, formed by the housing 3, is equal to the radius of the slug 14 before working. Thus, when the slug 14 is placed into the housing 3, it is centred by the shoulder of the impression 17. Moreover, this impression 17 may be arranged so as to pre-form the end of the slug 14 according to the shape which will be given to the final part by forging the slug 14, as soon as the upsetting operations are completed.

The lower surface of the punch 10, intended to come into contact with the upper surface of the slug 14, for pressing it and providing its upsetting, also includes an impression 18 for centering and pre-forming the slug 14, conformed according to the same criteria as the impression 17 of the bottom of the housing 3.

An upsetting operation or method for working the slug 14 will now be explained in more details.

The slug 14 may be a primary slug, which has not yet been upset, or a slug having already undergone one or more upsetting operations. It has a section of a certain diameter, preferably between 150 and 500 mm here. The upsetting device 1 is selected according to the diameter of the slug 14; the diameter of the housing 3 of the device 1 is larger than the diameter of the slug 14, preferably up to 1.35 times the diameter of the slug 14, in this case, equal to 1.3 times the diameter of the slug 14. According to the length of the slug 14, blocks 15, 16 may be placed beforehand on the bottom of the housing 3, in order to adjust the depth.

The slug 14 is heated beforehand, for example between 985 and 1100° C. if it is nickel-based metal, between 920 and 950° C. if it is titanium-based metal. It is put under standard rheological conditions for upsetting. The pot 2, in steel, as for it, is also heated beforehand, for example between 400 and 500° C., so that the steel is not located in its brittle strength range. The pot 2 was massively dimensioned, in this special case, more massive than required by mechanical criteria, so that heat is better retained.

The slug 14 is positioned in the housing 3, wherein it is centred by the impression 17 of the upper block 16. In order to provide optimum centering of the slug 14 and to avoid that its walls touch those of the housing 3, which might subsequently generate forging defects, an operator or a gripper of a machine, may also maintain the slug 14 centred, by its sidewalls, near its upper end. The slug 14 may be coated by vitrification, with an enamel layer, with which lubrication of the device 1 may be provided. This lubrication may be obtained by greasing.

The upper press table 12, initially in the high position as on the left half of the FIGURE, is then lowered, by a standard press hydraulic mechanism, driving the punch 10 towards the upper end of the slug 14. Upsetting then takes place, the punch 10 exerting, by action of the upper press table 12, pressure on the slug 14, which is upset, as it is contained in this special case initially for about three quarters of its height, in the housing 3. The punch 10 is lowered here, during the upsetting operation, at a rate from 10 to 20 mm/sec. Upsetting of the slug 14 is expressed by a reduction of its length and an increase in its section.

The upsetting operation is stopped when a certain stress is reached on the slug 14. The slug 14 then substantially fills the whole section of the housing, its section having increased by 30% here, its length having decreased accordingly, as there is no change in volume. In this situation, the punch is the low position, as is seen on the right half of the FIGURE. Slug 14 has actually been worked by upsetting.

The punch 10 is then moved back up out of the housing 3. The cylinder 9, driven by an ad hoc device, is actuated upwards and pushes back the blocks 15, 16 and the slug 14 in this direction, in order to have the slug 14 emerge from the housing 3. The slug 14 may therefore be removed and, either again upset, or, if the ratio of its length over its diameter has reached an acceptable value, in this special case 3 for 1, forged in order to manufacture the final part, a fan disc or a compressor drum of a turbojet engine here.

The cylinder 9 may be again lowered. The blocks 15, 16 may be removed or replaced by lifting the pot 2, which has the effect of freeing them and making them accessible.

Thus, it is possible to prepare a slug, for which the initial slenderness is larger than 12 for 1, for a forging operation, by upsetting the slug a plurality of times according to the method which has just been presented, until slenderness is obtained substantially equal to 3 for 1.

By means of the upsetting device 1 of the invention, it is possible to upset a slug 14 with large slenderness, typically with a ratio of more than 12 for 1, without any risk of buckling, as the slug 14 is either entirely or partially contained, in the cylindrical housing 3. Moreover, a cylindrical worked slug 14 is obtained at the end of the method, easy to forge according to any shape, the forging may be facilitated by pre-forming the ends of the slug 14 by the impressions 17, 18 of the bottom of the housing 3 and of the lower surface of the punch 10.

Because of retention of the slug 14 in the housing 3, the heat losses at its periphery are low, which improves the efficiency of the upsetting operation. Moreover, in the case of an incident generating a loss of time during the upsetting operation, it is not inevitably necessary to put the slug 14 and the pot 2 back into an oven to heat them up again, as the heat losses are low. In order to further reduce the heat losses, a heating device, for example resistors embedded in steel, may be provided in the walls of the housing 3, providing a constant and/or adjustable temperature of the housing 3.

By the possibility of putting blocks 15, 16 in the bottom of the housing 3, a same upsetting pot 3 may provide upsetting operations for slugs 14 of different lengths, which reduces the number of upsetting devices 1 required in a factory for producing metal parts obtained by forging slugs 14.

The invention claimed is:

1. An upsetting method for working a metal slug, having a slenderness, the method comprising:

heating said slug;

at least partly positioning the slug in the direction of its length in an upsetting pot defining a cylindrical housing, and exerting pressure on the slug in the direction of its length with a punch until the slug fills a whole section of the housing, so as to reduce its slenderness and to obtain a cylindrical slug with a section equal to that of the housing, wherein said exerting pressure begins on said slug having a slenderness larger than 12 to 1, and ends after said slug has a slenderness substantially equal to 3 to 1, wherein said slenderness of said slug is defined by a length-over-section-diameter ratio of said slug, wherein said exerting pressure is performed with a plurality of upsetting operations, during which pressure is applied to said slug so as to reduce its slenderness, each operation having a working rate larger than 30%, wherein said working rate is defined as a ratio of a first length of said slug before an upsetting operation over a second length of said slug after said upsetting operation.

2. The method according to claim 1, wherein the housing has a diameter up to 1.35 times the diameter of the section of the slug.

3. An upsetting device for working a metal slug according to the method of claim 1, said device comprising an upsetting pot with said cylindrical housing for receiving the slug and a punch for exerting said pressure on the slug.

4. The device according to claim 3, wherein the punch is driven by a press table.

5. The device according to claim 3, wherein the depth of the housing is adjustable according to the dimensions of the slug.

6. The device according to claim 5, wherein the bottom of the housing is arranged in order to be able to receive at least one block for adjusting the depth of the housing.

7. The device according to claim 3, wherein the upsetting pot comprises steel.

8. The device according to claim 3, wherein the diameter of the cylindrical housing is between 150 and 500 mm.

9. The device according to claim 3, comprising a cylinder for displacing the upset slug.

10. The device according to claim 3, wherein the bottom of the cylindrical housing includes an impression for centering and pre-forming the slug.

11. The device according to claim 3, wherein the surface of the punch for putting the slug under pressure includes an impression for centering and pre-forming the slug.

12. The method according to claim 1, wherein the step of heating said slug comprises heating said slug to a temperature between 985° C. and 1100° C.

13. The method according to claim 1, wherein the step of heating said slug comprises heating said slug to a temperature between 920° C. and 950° C.

14. The method according to claim 1, further comprising pre-heating said pot.

15. The method according to claim 14, wherein said pre-heating comprises heating said pot to a temperature between 400° C. and 500° C.

16. The method according to claim 1, further comprising lubricating said slug before positioning the slug in said pot.

17. A method of manufacturing a part for a turbojet engine, said method comprising upsetting a slug according to the method of claim 1, and further comprising forging said slug after said upsetting.

18. The method of claim 17, further comprising forming a fan disk or a compressor drum for a turbojet engine after said forging of said slug.

19. The method according to claim 1, further comprising providing said upsetting pot with said cylindrical housing having a diameter between 150 and 500 mm.

20. A method according to claim 1, wherein said slug is removed from said cylindrical housing between two successive upsetting operations.

* * * * *